US007210592B1

(12) United States Patent
Dautreppe et al.

(10) Patent No.: US 7,210,592 B1
(45) Date of Patent: May 1, 2007

(54) EASY-TO-OPEN COVERS

(75) Inventors: Bernard Dautreppe, Fayence (FR); Jacky Maugas, Ay (FR)

(73) Assignee: Pechiney Emballage Alimentaire, Clichy (FR)

( * ) Notice: Subject to any disclaimer, the term of this patent is extended or adjusted under 35 U.S.C. 154(b) by 0 days.

(21) Appl. No.: 09/831,918

(22) PCT Filed: Nov. 24, 1999

(86) PCT No.: PCT/FR99/02899

§ 371 (c)(1),
(2), (4) Date: Feb. 7, 2002

(87) PCT Pub. No.: WO00/30948

PCT Pub. Date: Jun. 2, 2000

(30) Foreign Application Priority Data

| | | |
|---|---|---|
| Nov. 25, 1998 | (FR) | 98 15004 |
| Feb. 22, 1999 | (FR) | 99 02322 |
| Jun. 7, 1999 | (FR) | 99 07364 |
| Jun. 7, 1999 | (FR) | 99 07365 |

(51) Int. Cl.
*B65D 53/00* (2006.01)

(52) U.S. Cl. ..... 215/246; 53/412; 206/497

(58) Field of Classification Search ..... 215/246, 215/251, 254, 253, 256, 258, 277, 278, 291, 215/326; 206/497; 53/488, 412, 137.1, 53/130.1, 134.1; 29/469.5
See application file for complete search history.

(56) References Cited

U.S. PATENT DOCUMENTS

| | | | | |
|---|---|---|---|---|
| 1,982,567 A | * | 11/1934 | Blanchard | 215/256 |
| 2,666,542 A | | 1/1954 | Price | |
| 2,780,379 A | * | 2/1957 | Ferguson | 215/256 |
| 3,924,771 A | * | 12/1975 | Cleff | 215/246 |
| 3,961,719 A | * | 6/1976 | Pierlot et al. | 215/348 |
| 4,000,824 A | | 1/1977 | Han | |
| 4,149,647 A | * | 4/1979 | Ritzenhoff | 215/254 |
| 4,391,383 A | * | 7/1983 | Babiol | 215/256 |
| 4,749,096 A | * | 6/1988 | Thomas et al. | 215/256 |

(Continued)

FOREIGN PATENT DOCUMENTS

| | | | |
|---|---|---|---|
| DE | 2234223 | * | 1/1974 |

(Continued)

*Primary Examiner*—Lien M. Ngo
(74) *Attorney, Agent, or Firm*—Dennison, Schultz & MacDonald

(57) ABSTRACT

The invention concerns an overcapping cover (1), comprising a head (5) and a skirt (4), and easy-to-open means, consisting of a line of weakness, borne by the skirt, and characterised in that: a) the easy-to-open means comprises at least a so-called lower line of weakness (44) located on the cover at a height H which defines a partition of said cover with a so-called upper part (10) and a so called lower part (11); b) said upper part (10) comprises a gripping tab (46) interposed between notches or recesses (460, 461); c) said cover comprises at least additional means selected among: a second line of weakness (43) in said upper part (10), means reinforcing (67) all or part of the lower part (11) means for fixing (66) on the neck of all or part of said lower part (11), means for reinforcing all or part of said upper part (10), such that when it is opened for the first time, the tear strip (45) formed by pulling the tab (46) removes along with it the whole upper part (10).

38 Claims, 14 Drawing Sheets

U.S. PATENT DOCUMENTS

| | | | | |
|---|---|---|---|---|
| 5,103,989 | A * | 4/1992 | Druesne et al. | 215/254 |
| 5,222,616 | A | 6/1993 | Druesne et al. | |
| 5,458,251 | A * | 10/1995 | Eguchi et al. | 215/254 |
| 5,509,552 | A * | 4/1996 | Eguchi et al. | 215/251 |
| 6,301,767 | B1 * | 10/2001 | Granger et al. | 29/469.5 |

FOREIGN PATENT DOCUMENTS

| | | |
|---|---|---|
| FR | 387267 | 7/1908 |
| FR | 2 134217 | 12/1972 |
| FR | 2617801 | * 1/1989 |
| FR | 2 762304 | 10/1998 |
| GB | 2 271333 | 4/1994 |

* cited by examiner

EASY-TO-OPEN COVERS

FIELD OF THE INVENTION

The invention relates to overcapping covers of bottles of sparkling wine, typically champagne, and in particular covers provided with easy-to-open means.

BACKGROUND ART

So-called easy-to-open covers, such as those in FIGS. 1 to 5, are already known. Typically there are two types of covers: those with a tear strip often called a "Tircell" shown in FIGS. 1 to 3, and those with a single or double dashed or dotted line of weakness shown in FIGS. 4 to 5.

PROBLEMS POSED

The easy-to-open systems that have been proposed previously pose a certain number of problems described below, irrespective of the system used.

As explained above the covers are applied typically to champagne bottles and they play a considerable role in the decorative aspect of the bottles and improve their appearance.

When consumers open the cover either by pulling on the Tircell strip or cutting the cover along the dashed or dotted lines they invariably either fold or accidentally tear the cover. This is because the covers are made of relatively thin sheets or films and the covers are not necessarily torn along the intended lines of weakness that are traced out in advance. The tearing may thus lead an unattractive appearance that is totally random.

Sparkling wines are also put into bottles that are often provided with cork wire that ensures the cork remains in place and the bottle remains sealed even in the event of excess pressure being applied. It is therefore necessary for the cover to free the cork and cork wire (if present) when it is removed.

In other words an easy-to-open cover is required that overcomes all these drawbacks.

AIM OF THE INVENTION

The invention relates to a cover that enables the user to remove its upper part, which is that covering said cork wire, in a single movement without damaging any of the lower part covering the section of the neck of the bottle beneath the cork wire, such that the maximum quantity of cover remains on the bottle in its attractive, undamaged condition while enabling the cork to be removed.

DESCRIPTION OF THE INVENTION

According to the invention the easy-to-open overcapping cover 1, which is typically conical, comprises a head 5 and a skirt 4 of a film or sheet material, typically for a recipient or bottle of sparkling wine 2 sealed with a cork 8 with a head 80 with means for fastening the cork to the neck of said recipient, typically a metal cork wire 3 provided with a tightening wire 30 that goes under the glass ring 20 of the neck of said bottle and constitutes an opening twist or loop 31, or possibly for a recipient or bottle of still wine comprising easy-to-open means, typically a line of weakness, on the skirt of said cover, and is characterized in that:

a) said easy-to-open means comprise at least one so-called line of weakness 44, described as being lower, located on the cover at a height H that defines a partition of said cover with a so-called upper part 10 and a so-called lower part 11; the height is such that after said cover and said recipient or sealed bottle have been assembled said line of weakness 44 breaks when said recipient or said bottle is first opened to provide access to said cork or possibly said cork wire once said upper part 10 has been removed, said lower part 11 remaining intact on the neck, b) said upper part 10 comprises a gripping tab 46 the upper and lower ends of which include notches or recesses 460, 461 intended to direct the tearing of a tear strip 45 during said first opening, c) said cover comprises at least one additional means selected from one of the following: a second so-called upper line of weakness 43 in said upper part 10, means 67 for reinforcing all or part of said lower part 11, means 66 for fastening all or part of said lower part 11 to the neck, means for reinforcing all or part of said upper part 10 such that when said recipient or bottle is opened for said first time said tear strip 45, which is created by pulling on gripping tab 46, removes the whole of said upper part 10 along with it, the lower edge of said strip being constituted when said line of weakness 44 breaks.

Height H is typically between 15 and 50 mm for recipients or bottles of sparkling wine and between 5 and 25 mm for recipients or bottles of still wine.

When covers are intended to overcap recipients or bottles of sparkling wine said fastening means may also consist of a staple hooked under the glass ring of the neck or a threaded cap that operates in conjunction with a threaded ring.

When the fastening means comprise a cork wire provided with an opening twist the line of weakness should be located at such a height that when the cover is applied to said neck it is slightly below the opening twist under the glass ring.

The situation is similar when the fastening means comprise a staple because the ends of the staple, similarly to the opening twist, hook under the glass ring that constitutes a contracted circular section.

The fastening means may consist of a threaded glass ring that operates in conjunction with a cap with a threaded skirt. In this configuration the line of weakness is located just below the lower end of said threaded skirt.

Tests performed on covers of the invention and the background art have shown clearly the benefits of combining the means described above in a), b) and c). The applicant has therefore taken advantage of these means to realize the aim in question, i.e. to remove the entire upper part of the cover in a single movement by pulling between the thumb and index finger of one hand while the other holds the bottle without damaging the lower part of the cover and decoration.

The cover of the invention therefore enables the cover to be opened correctly under "standard" opening conditions. "Opened correctly" implies removing the upper part of the cover while leaving the lower part intact, with a dividing line between the two parts that is typically a circle, such that the neck of the bottle remains covered with the lower part of the cover and said cover remains attractive.

Tests performed on covers of the invention and the background art have shown clearly that the invention alone enables the cover to be removed correctly and repeatedly without the consumer having to be particularly careful when opening the cover, as is usually the case.

It is important to realize how covers behave when they are opened under "standard" conditions which are typically in social occasions when the person opening the bottle is talking to somebody or in any event is not particularly looking at the cover of the bottle to be opened.

It is under these "standard" conditions that the cover of the invention is of particular interest. Covers of the background art are only opened correctly provided the "Tircell" or the tear strip is pulled in a direction that always remains perpendicular to the axis of the bottle. This is only possible if great care is taken otherwise the "Tircell" does not follow the tear lines and the part of the skirt is torn that should not be or the upper part of the skirt is not correctly torn to reveal the cork wire. The problem is therefore resolved by the combination of the means described in a), b) and c).

DESCRIPTION OF THE FIGURES

In FIGS. 1 to 3 the easy-to-open means are "Tircell" strips 41 one end of which is oriented in a more or less sloping direction.

In FIG. 4 the means is a double line of weakness 42 and in FIG. 5 a single line 40.

In principle these means enable upper part 10 of cover 1 to be removed and leave lower part 11 on the bottle.

Figure 6:
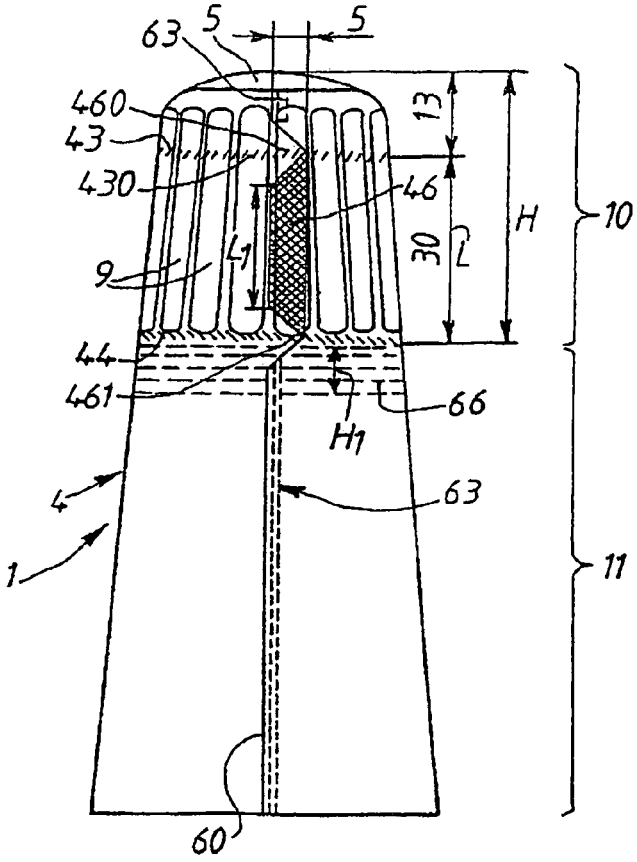

FIG. 6 is a side view of a conical cover 1 according to a embodiment of the invention.

Figures 6A, 6B:
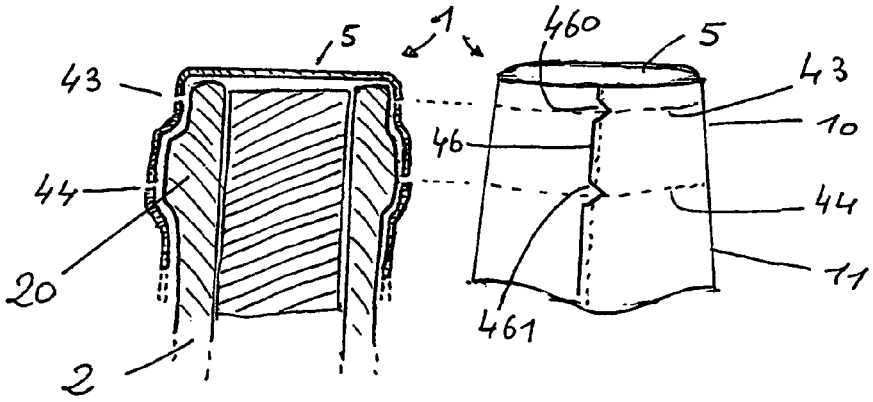

FIGS. 6*a* and 6*b* relate to the upper part of covers 1 that constitute overcapping caps for bottles 2 of still wines sealed with a cork stopper. FIG. 6*a* is a schematic cross-section along the vertical axis and FIG. 6*b* is a perspective side view in which opening tab 46 is shown positioned between the upper 43 and lower 44 lines of weakness, said lower line of weakness being located on glass ring 20 of bottle 2, skirt 4 of the cover being crimped under glass ring 20.

Figure 7:
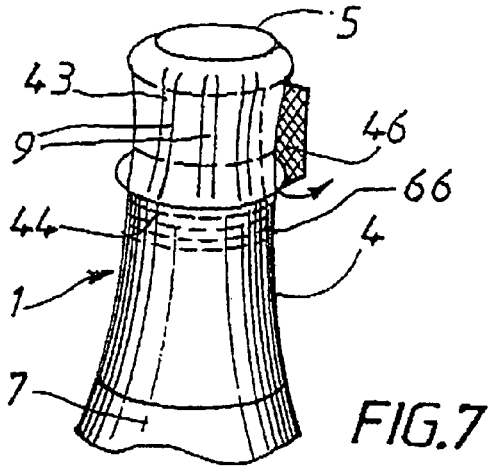

FIG. 7 is a side view of a neck 7 of a bottle provided with a cover 1 of the invention where tab 46 is shown in the unfolded position ready to be gripped by the consumer, the tab before the cover is opened being folded back and flat against the cover as shown by the dotted line in the figure such that it does not extend beyond the rest of the cover and risk being pulled accidentally.

Figure 8:
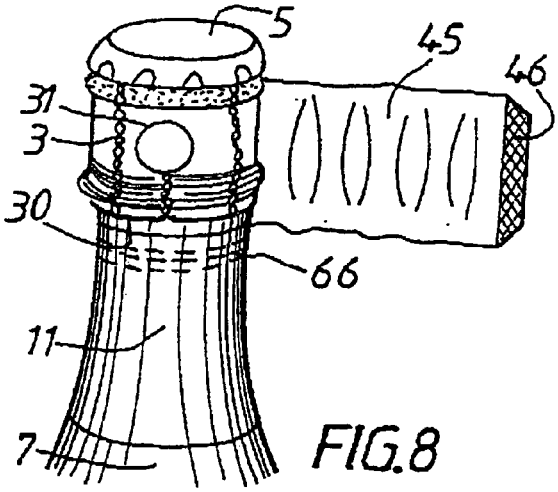

FIG. 8 is a similar side view to that of FIG. 7 once the consumer has pulled tab 46 to create opening strip 45 and thus revealed cork wire 3 comprising a tightening wire 30 that goes under the glass ring and a tightening loop 31.

Figure 9:
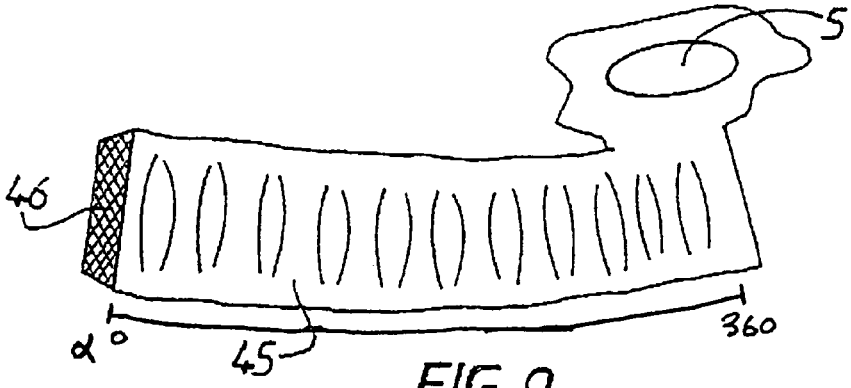

FIG. 9 shows the result obtained after said cover has been opened easily, upper part 10 of the cover comprising head 5 remaining fastened to opening strip 46.

Figure 10:
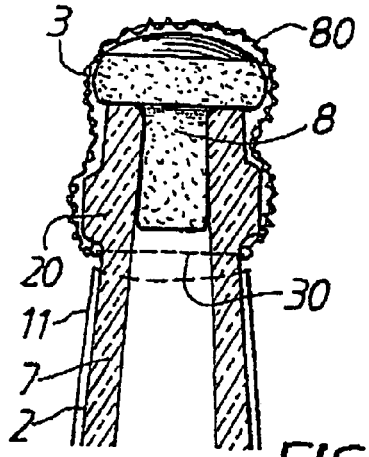

FIG. 10 is a cross-section view of neck 7 of a bottle 2 showing the result obtained after the upper part of cover 10 has been removed, with a cork wire 3 covering a cork 8 and holding it in position with a tightening wire 30 that goes under glass ring 20 of the neck of the bottle, and with a lower part 11 of cover 1 held in place on neck 7.

Figure 11A:
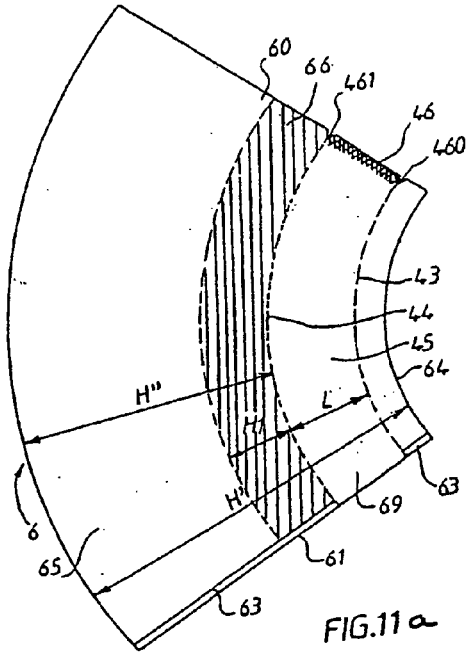
Figure 11B:
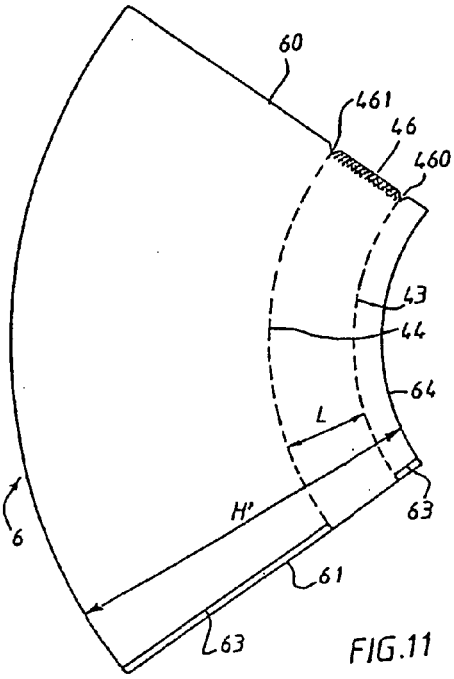

FIGS. 11*a* and 11*b* show top views of the inner surface of two arcs 6 of height H' of conical skirt 4 of the cover consisting of a film or sheet material the outer surface of which is generally printed or decorated, used to produce said cover and including:

- two upper 43 and lower 44 lines of weakness ending in notches 460, 461 along the axial edge 60 that constitutes the upper edge after said arc has been rolled, and a checkered tab 46, lower line of weakness 44 defining an upper part 69 and a lower part 65 of height H",
- a line of adhesive 63 along the other axial edge 61,
- an upper rim 64 to which the head of the cap is fastened,
- and, in the configuration in FIG. 11*a*, a fraction of said lower part 65 the inner surface of which is coated with an annular adhesive layer 66 of height H1 that is activated when the cover is positioned on the neck, said layer being represented in FIG. 11 and following figures by vertical hatching.

FIGS. 12*a* to 15*b*, which are similar to FIGS. 11*a* and 11*b*, show other embodiments of the invention.

In these figures the adhesive layers on lower part 66 are shown by vertical hatching, strengthening layers 67 are shown by horizontal hatching and the superimposition of a reinforcement and an adhesive layer 68 is shown by crossed hatching.

Figure 12A:
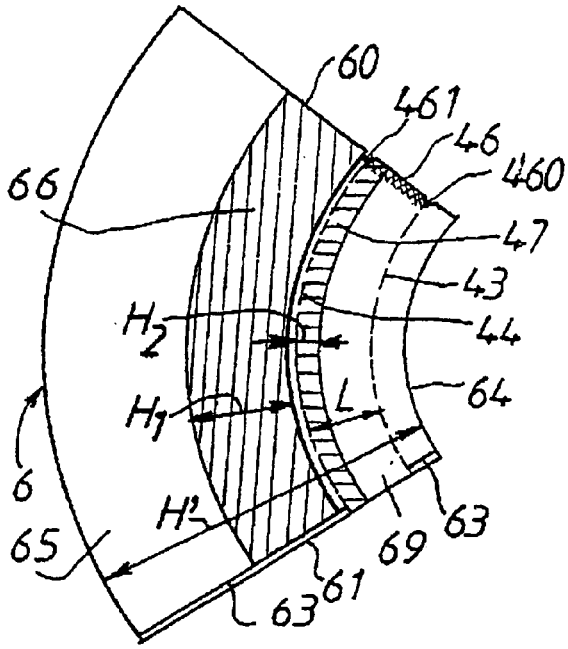
Figure 12B:
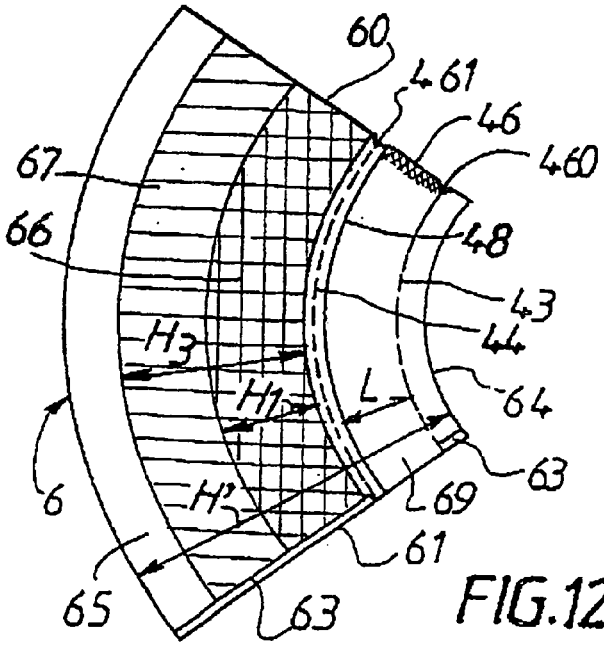
Figure 13A:
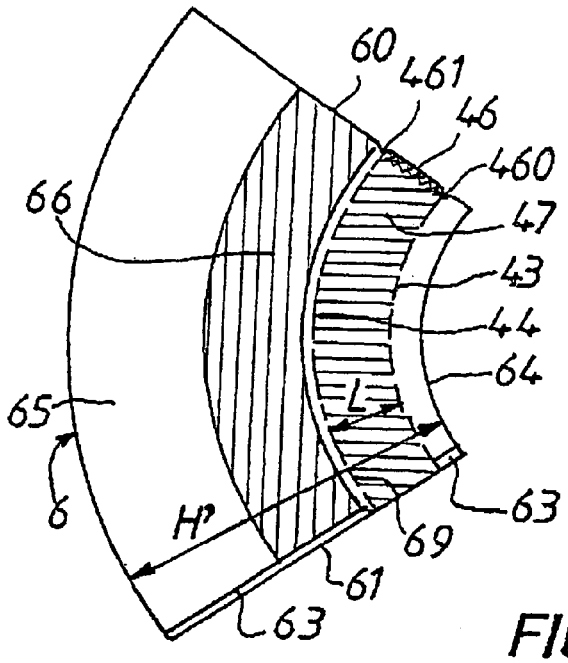
Figure 13B:
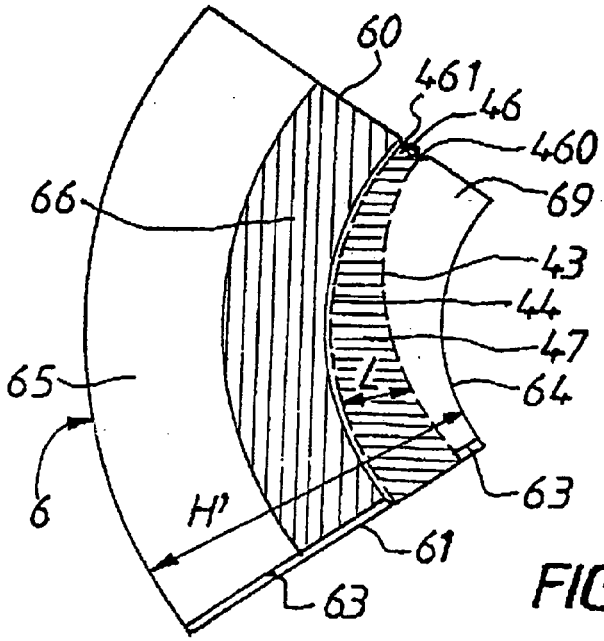
Figure 14A:
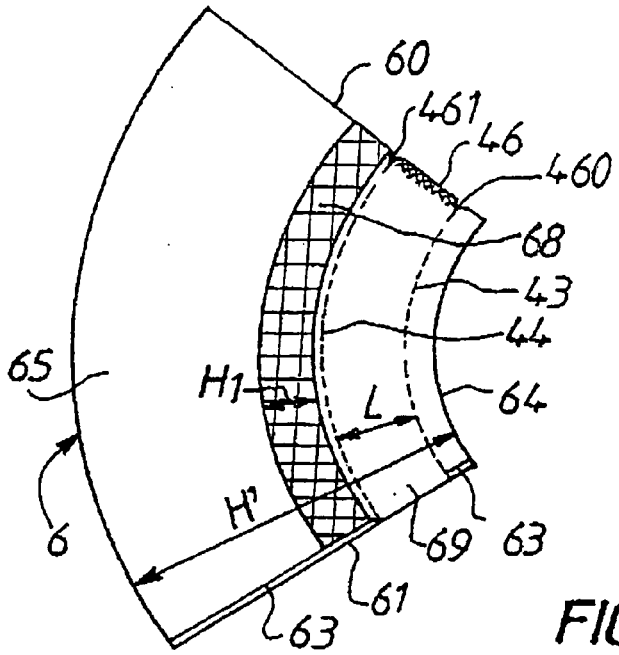
Figure 14B:
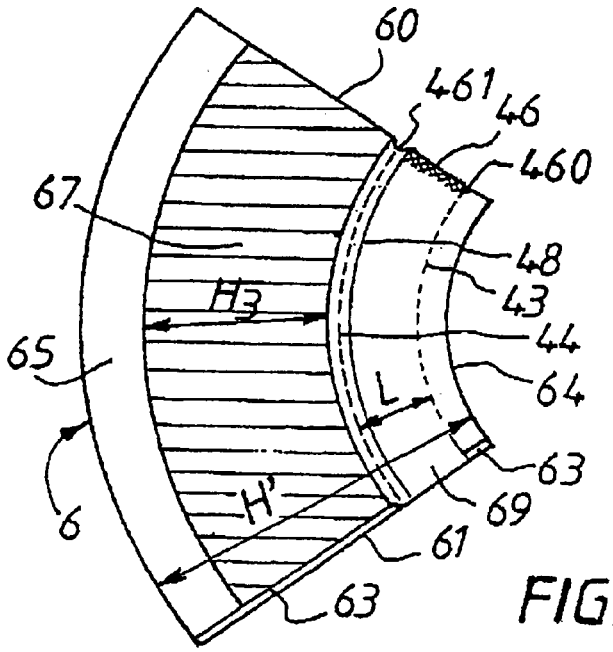
Figure 15A:
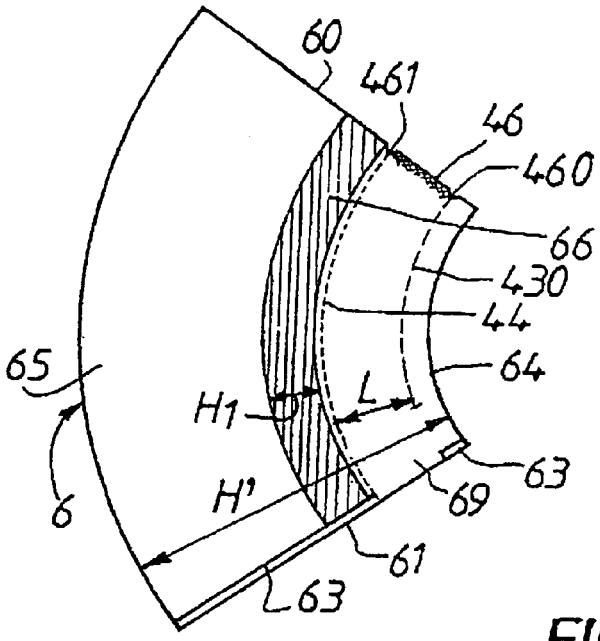
Figure 15B:
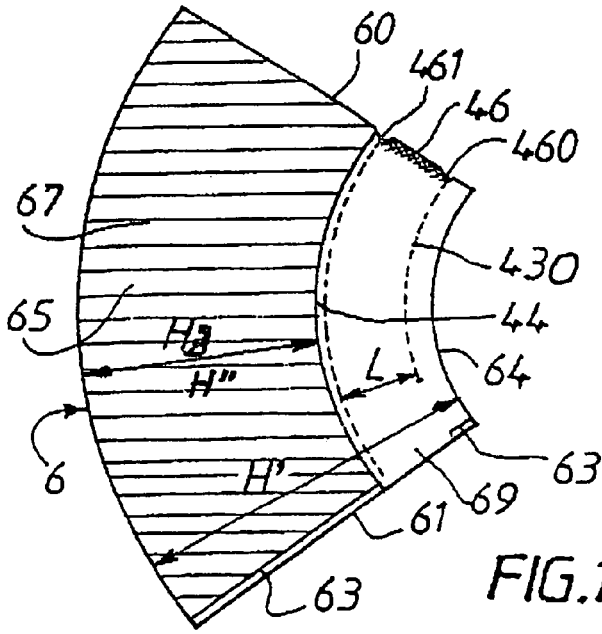

Therefore:

| | Upper part 69 | Lower part 65 |
|---|---|---|
| FIG. 12a: | reinforcement 47 of height $H_2$ | adhesive layer 66 of height $H_1$ |
| FIG. 12b | strengthening strip 48 | adhesive layer 66 of height $H_1$ on bonded reinforcement 67 of height $H_3$ |
| FIG. 13a | reinforcement 47 of height $H_2$ with $H_2 = L$ | adhesive layer 66 of height $H_1$ |
| FIG. 13b | reinforcement 47 of increasing height $H_2$ | adhesive layer 66 of height $H_1$ |
| FIG. 14a | no reinforcement | adhesive reinforcement 68 of height $H_1$ |
| FIG. 14b | strengthening strip 48 | bonded reinforcement 67 of height $H_3$ |
| FIG. 15a | no reinforcement | adhesive layer 66 of height $H_1$ |
| FIG. 15b | no reinforcement | bonded reinforcement 67 of height $H_3$ = H" |

In FIGS. 15*a* and 15*b* upper line of weakness 430 is partial such that head 5 is fastened to opening strip 45 as illustrated in FIG. 9.

Figure 16:
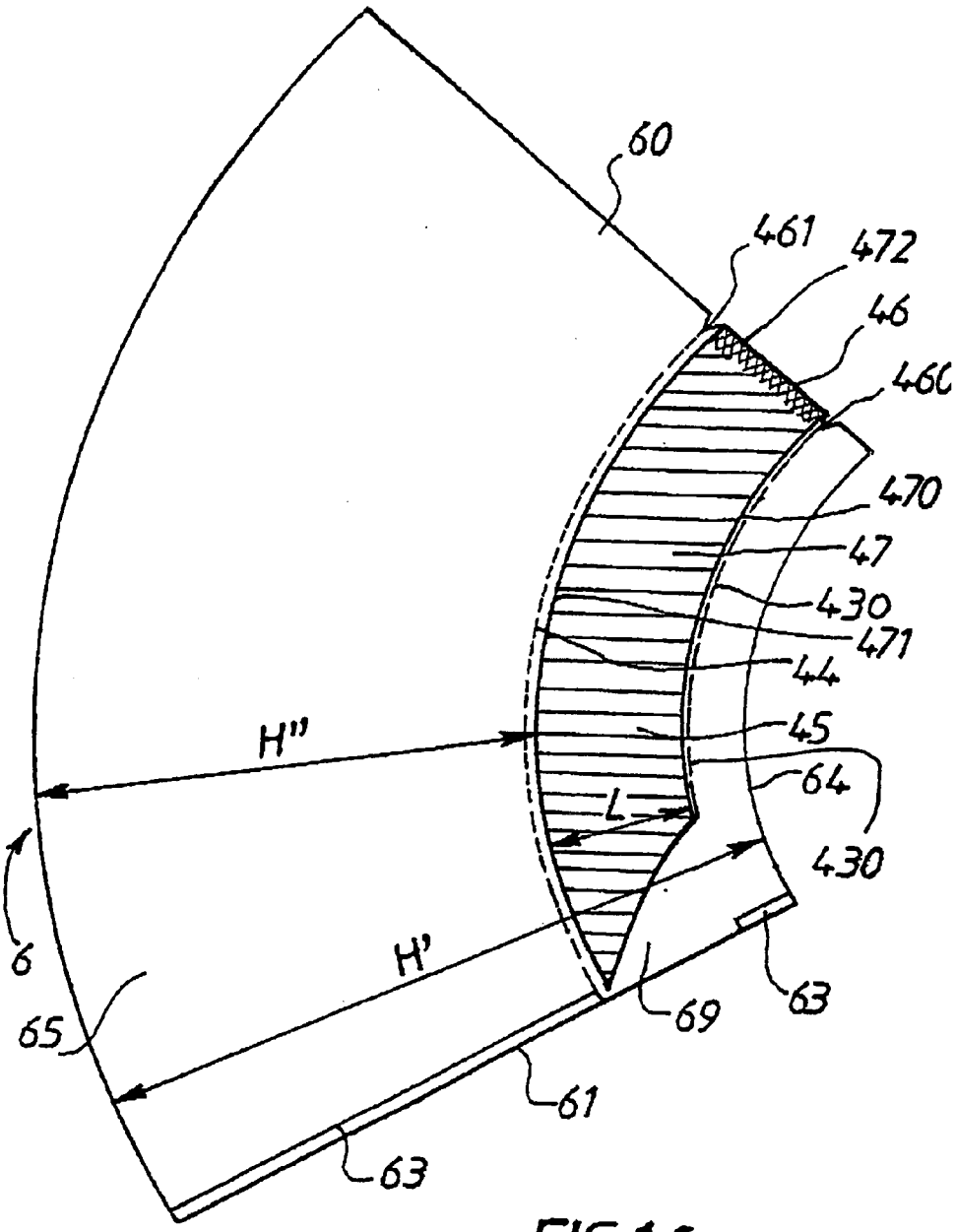

FIG. 16 is a top view of the inner surface of an arc 6 of conical skirt 4 of the cover consisting of a film or sheet material the outer surface of which is generally printed or decorated, used to produce said cover and including:

- two upper 430 and lower 44 lines of weakness ending in notches 460, 461 along the axial edge 60 that constitutes the upper edge after said arc has been rolled, and a checkered tab 46, lower line of weakness 44 defining an upper part 69 and a lower part 65 of height H", upper line of weakness 430 being a partial line that does not describe a full circle such that head 5 remains fastened to opening strip 45,
- an upper reinforcement 47 of width L positioned between the two line of weakness 43 and 44, one end of which 472 constitutes a reinforcement of tab 46.

Arc 6 of height H' has an upper rim 64 to which the head of the cap and a lower part 65 of height H" are fastened.

FIGS. 17*a* to 21*b* are similar to FIG. 16 and show other embodiments of the invention.

Figure 17A:
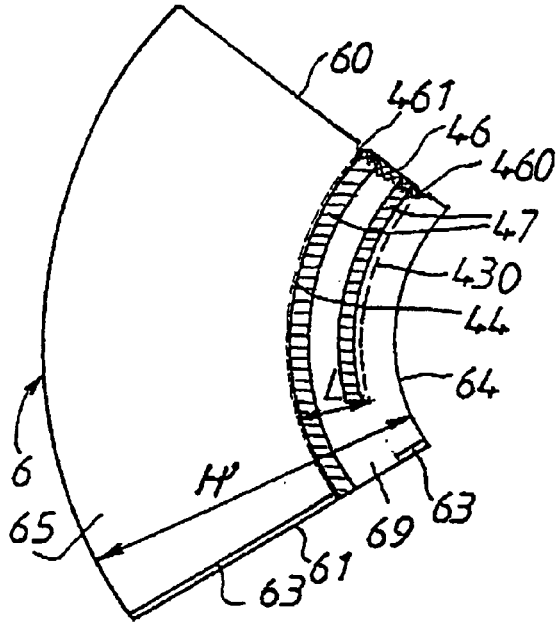

In FIG. 17*a* upper reinforcement 47 consists of two strips, each one being near a line of weakness 43, 44.

Figure 17B:
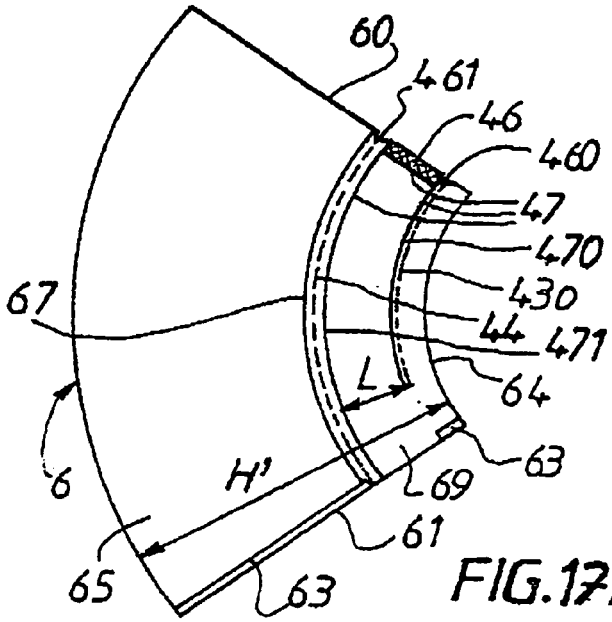

In FIG. 17*b* upper reinforcement 47 comprises a thin strip or line of plastic material positioned along lines of weakness 43, 44 and along tab 46.

Figure 18A:
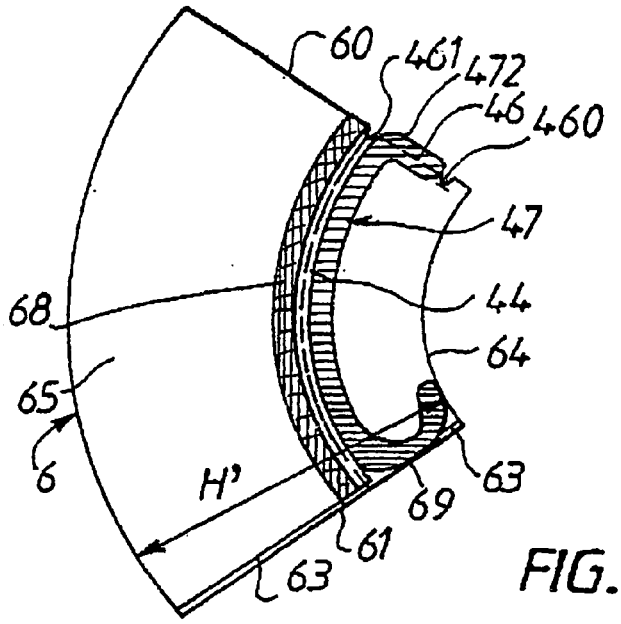

In FIG. 18*a*, only line of weakness 44 is present. An end 472 of upper reinforcement 47 extends beyond said gripping tab, said end acting as a gripping tab, upper reinforcement 47 extending along lower line of weakness 44. Upper notch 460 is used to start the tearing of the upper part and to direct said tearing such that it is stopped by the other end of the upper reinforcement to enable head 5 of the cover to remain fastened to opening strip 45.

In this figure lower part 65 of arc 6 comprises a reinforcement strip coated with an adhesive reinforcement 68 that can be activated.

Figure 18B:
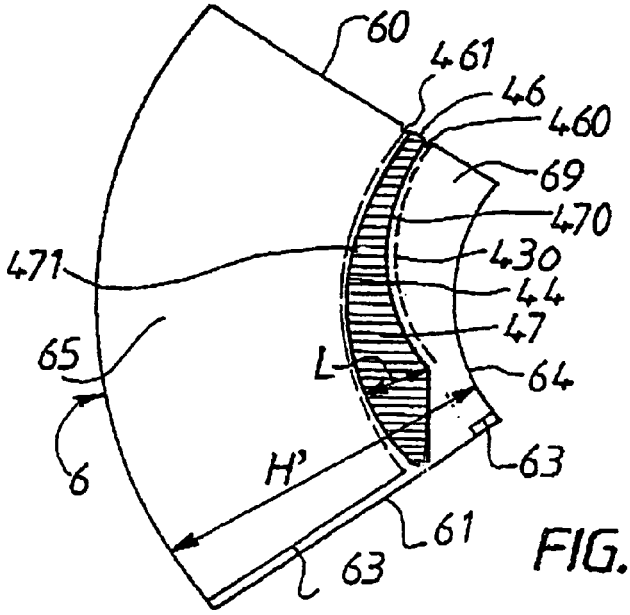

In FIG. 18*b* upper reinforcement 47 has a variable width that first of all increases, if tab 46 is taken as the origin, and then reduces. Lower edge 471 of said upper reinforcement is adjacent to lower line of weakness 44 while upper edge 470 is adjacent to upper line of weakness 43.

Figure 19A:
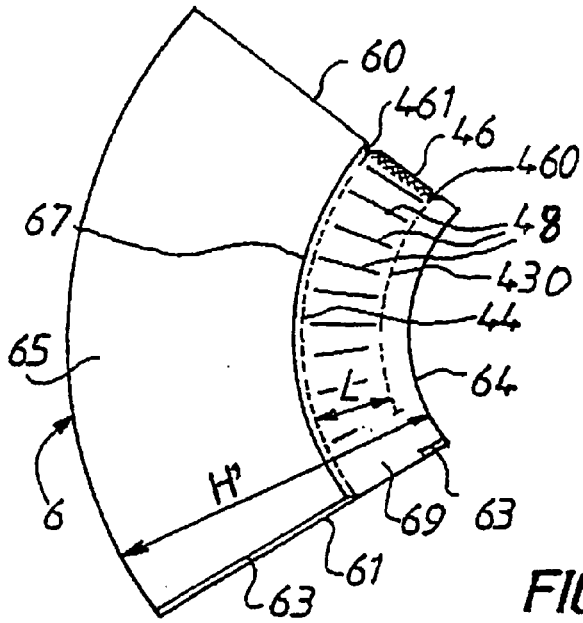

In FIG. 19*a* upper reinforcement 47 consists of a row of strips or lines 48 of plastic material or varnish that extend from one line of weakness 43 to the other 44. Arc 6 has a lower reinforcement 67 that also consists of a strip or line.

Figure 19B:
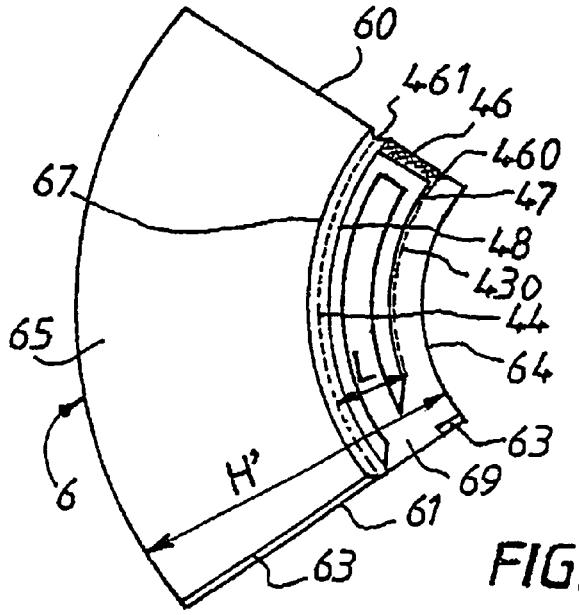

In FIG. 19*b*, which is similar to FIG. 19*a*, upper reinforcement 47 is a track that constitutes a conducting mouth that can be used for detection purposes.

Figure 20A:
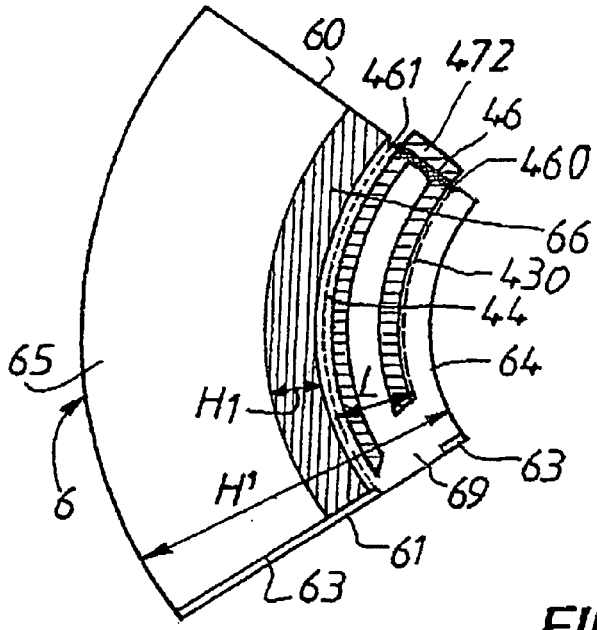

In FIG. 20*a*, part of which is similar to FIG. 17*a*, the upper reinforcement has an end 472 that extends beyond said tab 46 as in FIG. 18*a*, lower part 65 having a part 66 coated with a layer of adhesive that can be activated.

Figure 20B:
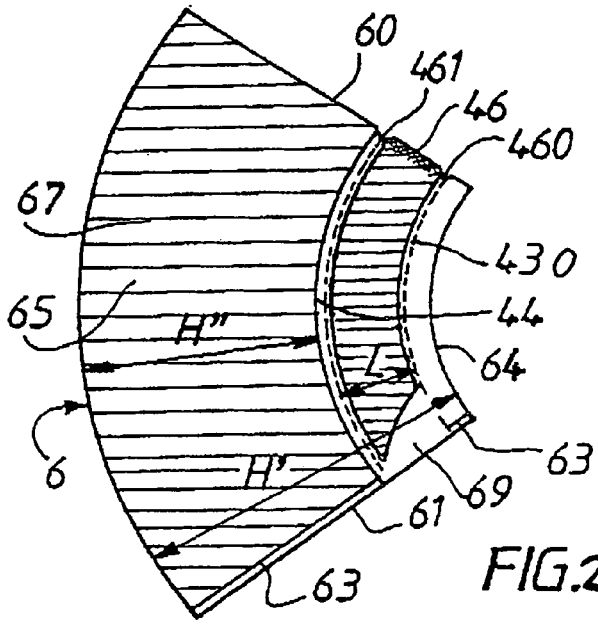
Figures 21A, 21B:
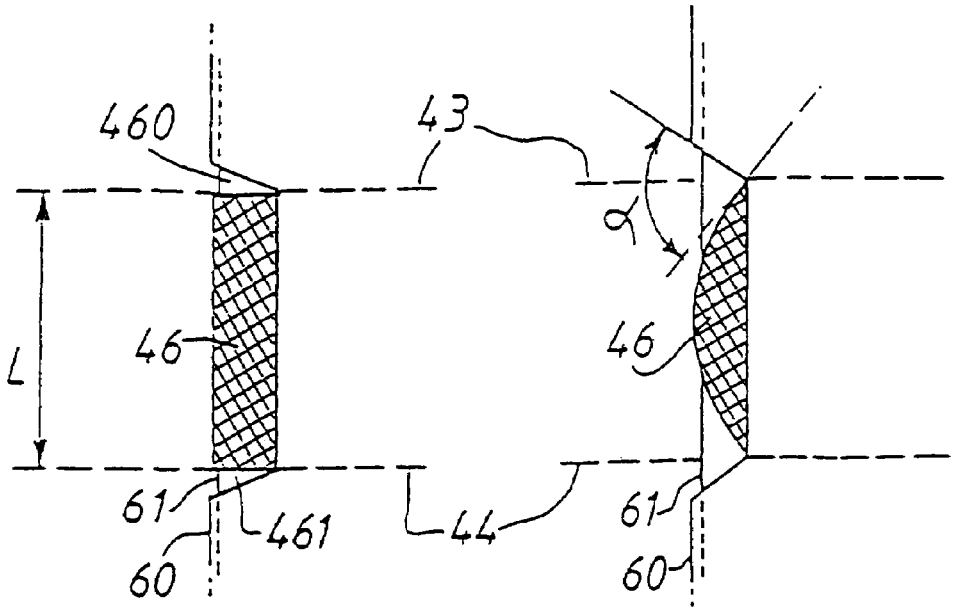
Figures 21C, 21D:
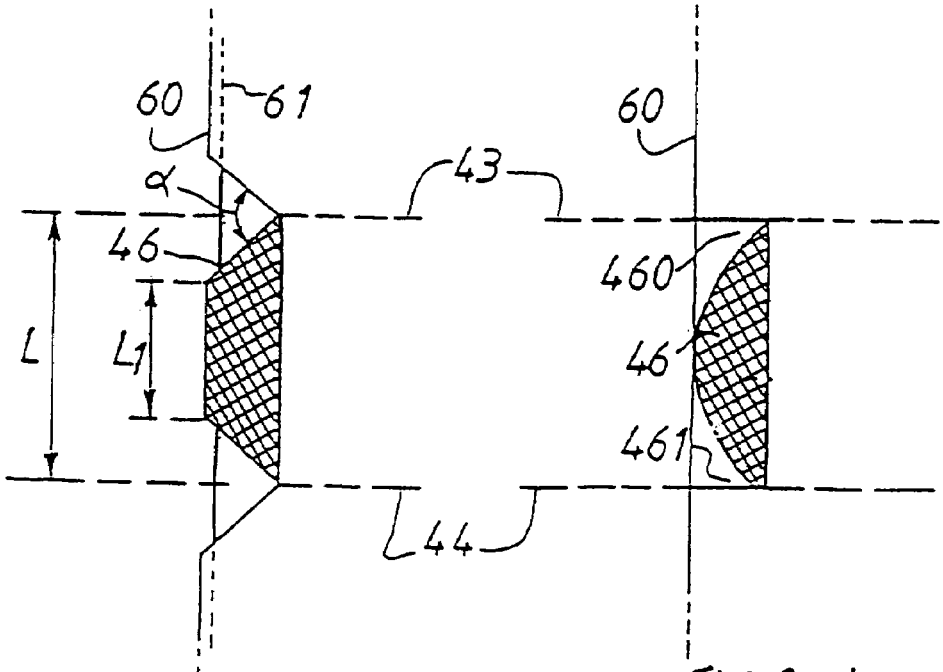

In FIG. 20*b*, which is similar to FIG. 16, lower part 65 is covered with a lower reinforcement 67.

FIGS. 21*a* to 21*d* are of various types of tabs 46 of the invention.

DETAILED DESCRIPTION OF THE INVENTION

According to a first embodiment of the invention the cover may comprise, as an additional means, a so-called second line of weakness 43 all or part of which is separated towards the top of the so-called lower line by a distance L at least equal to 0.5 H, H being the height between the so-called lower line and the upper or top end of said cover 1, lines of weakness 43, 44 that define an opening strip 45 of width L.

Advantageously, said line of weakness may not extend around the entire periphery of the cover and constitutes a partial line of weakness 430 such that head 5 of the cover remains fastened to opening strip 45. Partial line of weakness 430 extends at an angle $\alpha$ that ranges typically between 240 and 320°.

Gripping tab 46 is typically positioned along a generating line of said cone and is located between two lines of weakness 43, 44 and fastened to said opening strip 45, said tab 46 using said notches 460, 461 to automatically direct the tearing strain when said cover is opened towards said two lines of weakness such that said cover is opened easily, ensuring the remaining lower part 11 of the cover located beneath said lower line 44 stays intact and said cork wire 3, if fitted, is freed. FIGS. 21*a* to 21*d* are of various types of tabs 46 of the invention.

Said tab 46 may comprise notches or recesses 460, 461 made in said film or sheet material constituting said cover, said notches constituting the means to direct the tearing strain of said strip 45.

Typically width $L_1$ of said tab 46 ranges from 0.5 L to L with L ranging between 1.5 and 4 cm.

All the figures of covers of the invention (FIGS. 6 to 20) include a tab 46 that has an upper notch 460 and a lower notch 461 running along its edges in the axial direction.

In most of these figures the covers or arcs of the covers comprise a so-called second upper line of weakness 43 all or part of which is separated from the top of the so-called lower line by a distance L at least equal to 0.5 H.

FIG. 18*a*, however, shows a cover comprising a single line of weakness 44 whereas FIG. 11*b* shows a cover comprising only two lines of weakness without any additional means.

FIG. 18*b* shows a cover comprising a tab of increasing width.

In a second embodiment of the invention the cover may comprise, as an additional means, means for reinforcing lower part 11, 65. Said means may consist of a lower reinforcement 67 that increases the mechanical properties of all or part of said lower part 11 and adheres to all or part of the inner surface of said lower part 11, 65 at least along said lower line of weakness 44 and parallel to said lower line of weakness, said lower reinforcement 67 may also comprise an adhesive layer that can be activated over all or part of the surface that is intended to adhere to said neck.

This embodiment is shown in FIGS. 12*b*, 14*a*, 14*b*, 15*b*, 17*b*, 18*a*, 19*a*, 19*b*, 20*a* and 20*b*.

The entire lower reinforcement 67 may comprise a layer that can be activated and constitutes a circular strip 68 the width of which is at least equal to 5 mm and that can extend over all or part of the height of said lower part 11 and that is adjacent to at least the upper edge of said lower part 11 along and parallel to said lower line of weakness 44.

This embodiment is shown in FIG. 14*a*.

In a third embodiment of the invention the cover may comprise means for fastening all or part of said lower part 11, 65 as additional means. Therefore, said lower part 11 may comprise a layer of glue or adhesive on all or part of the inner surface as fastening means that can be activated and that constitutes a part 66 adhered to said neck, typically after the adhesive has been activated.

Said glue or adhesive may comprise a complex layer consisting of a layer that adheres to the glass and a layer that adheres to the material comprising the inner surface of said cover, typically aluminum, paper or a layer of plastic material or varnish.

This embodiment is shown in FIGS. 11*a*, 12*a*, 12*b*, 13*a*, 13*b*, 14*a*, 15*a*, 18*a* and 20*a*.

In FIGS. 11*a*, 12*a*, 13*a*, 13*b*, 15*a* and 20*a* the material constituting lower part 11 of the cover is bonded directly to the neck (reference 66 in this configuration) whereas in FIGS. 12*b*, 14*a* and 18*a* the lower reinforcement is bonded to the neck and in FIGS. 14*a* and 18*a* the lower reinforcement is a strip (reference 68) adhering to the neck.

In a forth embodiment of the invention the cover may comprise a so-called upper reinforcement means as additional means. Reinforcement means 47 of said upper part is selected, particularly in terms of type and position on the inner surface of said upper part, to increase the mechanical properties of all or part of said upper part such that when said recipient or bottle is opened for said first time said opening strip 45, which is created by pulling on gripping tab 46, removes the whole of said upper part 10 along with it.

Said upper reinforcement means 47 may comprise a lateral end 472 that reinforces all or part of said gripping tab 46. Said lateral end 472 may extend beyond said gripping tab such that said lateral end 472 assumes the role of said gripping tab when the cover is first opened, as shown in FIGS. 18*a* and 20*a*.

Reinforcement means 47 may comprise a reinforcement strip or line that has a lower edge 471 adjacent to at least lower line of weakness 44.

FIGS. 13*a*, 13*b*, 16, 18*b*, 20*b* show configurations in which the upper reinforcement is a strip that covers and reinforces the inner surface of opening strip 45.

FIGS. 12*a*, 12*b*, 17*a*, 17*b*, 18*a*, 19*b* and 20*a*, on the other hand, show various types of reinforcement strips certain of which are only adjacent to the lower line of weakness (FIGS. 12*a*, 12*b*, 14*b*) and constitute a very thin line 48, as shown in FIGS. 12*b* and 14*b*.

Said reinforcement means 47 may comprise an upper part or edge 470 that may or may not belong to the same reinforcement strip or line, said upper 470 and lower 471 edges being separated by a width L, that is constant or otherwise depending on angular position α, width L ranging typically between 0.4 and 4 cm, average width L being preferably between 0.3 and 0.7 times H, H being the height between the so-called lower line and the upper end or top of said cover 1.

FIGS. 12*a* to 13*a* and 16 to 20*b* are non-limitative examples of the very wide range of reinforcement means 47 possible according to the invention.

As illustrated in FIGS. 13*b* and 18*b*, width L is not necessarily constant and increases, typically regularly, with the angular position α, width L being at its smallest at said tab 46 where angle α is equal to 0, as shown in FIG. 9.

According to different versions, said upper reinforcement means 47 may cover the entire interior surface (see FIGS. 13*a*, 13*b*, 16, 18*b*, 20*b*) or inner periphery of the free part of said opening strip 45 (see FIGS. 17*a*, 17*b*, 19*b*, 20*a*).

FIGS. 18*a* and 19*a* show particular reinforcements in that there is a single line of weakness 44 in FIG. 18*a* and that the reinforcement in FIG. 19*a* consists of a row of lines 48 more or less parallel to each other.

FIGS. 11*a* to 20*b* (except FIG. 11*b*) show various combinations of additional means.

At least one of the additional means is required in order to implement the invention but 2, 3 or 4 of these additional means may also be used simultaneously, as shown in FIG. 12*b*, depending on which aspects of the invention are to be set off to advantage.

According to the invention said upper 47 or lower 67 reinforcement means may consist either of a thin sheet or reinforcement strip, typically of a plastic material (preferably PET or PP), paper, or a layer, strip or line of plastic, resin, varnish or paint material and generally of any means that provide a localized increase in the mechanical characteristics and enable the objectives of the invention to be realized.

According to the invention the material constituting said cover may be selected from sheets or strips of Al or Al alloys, Sn or Sn alloys, shrinkable plastic, Al/PO/Al complex multilayers, Al/PO/paper, PO/Al/PO, charged PO/Al/PO, where Al refers to a layer of aluminum, PO a layer of polyolefin (preferably PE) capable of containing a charge that is typically mineral.

The thickness of said material in sheets or strips may range between 25 and 50 μm when the material is aluminum or an alloy, between 110 and 150 μm when the material is tin or an alloy, between 60 and 100 μm when the material is a shrinkable plastic film and between 60 and 110 μm when the material is a complex multilayer material, typically Al/PO/Al.

Another aim of the invention consists in a method for producing covers 1 of the invention, a method in which:

a blank of arc 6 of said skirt is cut out of said film or sheet material of height H', said lower line of weakness 44 and said notches 460, 461 are provided on an axial edge 60, said additional means are provided, being selected from said upper line of weakness 43, said upper reinforcement means, said lower reinforcement means, a radial line of heat- or pressure-activated adhesive 63 is applied, typically on the other axial edge 61 of said arc, except on the part matching or opposite said tab 46, said arc 6 is rolled on a chuck by folding axial edge 60 back onto the other axial edge 61, a line of adhesive is applied between the two edges, or said pre-applied radial line of adhesive is activated, to shape said skirt 4 by pressing edges 60, 61 together and possibly creating said grooves 9, and a head 5 is assembled or created, possibly by adding a part of the head and fastening it typically by thermobonding to upper rim 64 of said skirt that is possibly shrunk and folded.

FIGS. 11 to 20*b* show arcs 6 of the invention before they are rolled.

In the method of the invention the upper or lower reinforcement can be deposited either by bonding a strip or part of a strip 47 with the mechanical characteristics required, which are typically resistance to tearing, and of a required shape, which is typically part of an annular sector, or by using a gun to apply a strip or line 48 of melted plastic material that is adherent and that hardens when applied.

According to the invention said upper and lower reinforcement means may be a self-adhesive label of suitable shape applied to said arc 6.

The method of the invention can be perfectly integrated into the standard methods used to shape covers by rolling arcs and it therefore constitutes a method that is just as economical and productive as the standard method.

A further aim of the invention relates to the use of a cover of the invention as an overcapping cap for still wines. Once the measurements of the covers of the invention have been suitably modified they may be used to overcap bottles of still wines, which are typically sealed with a cork, without or without a head. In this configuration the covers do not generally include grooves 9 and said additional means is preferably a second line of weakness 43.

Lower line of weakness 44 is preferably located on glass ring 20, which is specific to bottles of still wine.

Examples of Embodiments

Conical covers 1, such as that in FIG. 6, have been have been produced by rolling arcs as shown in FIGS. 15*a* (test 1) and 15*b* (test 2) according to the method described above.

The cover in FIG. 6 comprises a skirt 4 and a head 5 with two lines of weakness: an upper line 43 and a lower line 44 separated from each other by a distance L of 30 mm, lower line 44 defining the upper or separable part 10 of the cover and the lower or fixed part 11 of the cover. The cover is shaped by rolling an arc 6 of a skirt according to FIG. 11*a* and thermobonding or bonding an axial edge 60 to the other edge 61 (not shown in FIG. 6). A dotted line shows line of adhesive 63 that seals the two edges together.

Before the cover is rolled lines of weakness 43, 44 and notches 460, 461 that define said 46 are created, the bottom of each notch 460, 461 being located on the corresponding line of weakness 43, 44. As shown in FIGS. 6 and 11*a*, said tab 46 is checkered, i.e. provided with a lattice-work of small scores obtained by stamping when said arc and notches are cut out, in order to differentiate the tab visually and in terms of its appearance and to reinforce the visual contrast between the tab and the rest of the cap to encourage the consumer to use said tab 46 immediately in order to open the cover.

Upper part 10 of the skirt is provided with a row of grooves 9 that have both a visual and a technical function as they can enable line of weakness 44 to be broken cleanly without tearing lower part 11 of the skirt accidentally.

The inner surface of lower part 11 of the skirt is coated with an annular layer of adhesive 66 that is activated when the cover is applied to the neck and is shown by a dotted line at height $H_1$ in FIG. 6.

The measurements of the produced covers are given in FIG. 6 with namely:

L=30 mm,

H=43 mm,

The width $L_1$ of the checkered tab shown in FIG. 6 is 25 mm.

The angle at the bottom of notches 460, 461 was selected as 75°.

The conicity of cover 1 is 6°, i.e. the angle formed by the oblique surfaces of skirt 4 shown in FIG. 6.

The measurements of arcs 6 in FIGS. 11, 15*a* and 15*b* are:

H'=130 mm

H"=80 mm

Test 1:

A 40 μm-thick strip of aluminum was used as a material the outside surface of which was decorated with a gold-colored varnish.

Cover arcs 6 were shaped according to FIG. 15*a* by applying a layer of widely available, water-activated adhesive to a height $H_1$ equal to 5 mm using screen printing techniques.

Test 2:

A 68 μm-thick strip of Al/PE/Al complex material was used the outer surface of which was decorated with a gold colored varnish.

A reel consisting of a strip support was loaded with self-adhesive paper labels of a suitable shape and height $H_3$ of 25 mm. The labels were then transferred to the blanks of arcs 6.

Test 3:

This test is similar to test 2. It differs in that a reel consisting of a strip support was loaded with self-adhesive paper labels coated with a layer of widely available, water-activated adhesive.

Other Tests:

Covers similar to the above were also produced in 30 μm-thick strips of corrugated aluminum but that also comprised an upper reinforcement 47 for said upper part 10 that was positioned just above so-called line of weakness 44.

In a first embodiment, such as that shown in FIGS. 12*a*, 17*a*, 18*a* and 20*a*, upper reinforcement 47 consists of a PE-based black strip that adheres to the sheet of aluminum and is typically 5 mm wide, said strips running along line(s) of weakness 43, 44.

In a second embodiment, such as that shown in FIGS. 12*b*, 14*b*, 17*b*, 19*a* or 19*b*, upper reinforcement 47 is provided by applying a "hot-melt" type of resin line 48 using an application gun containing melted resin that solidifies when it comes into contact with the sheet of aluminum.

According to one version of this embodiment a line of resin is applied that is quick drying when exposed to ultraviolet rays.

In a third embodiment, such as that shown in FIGS. 13*a*, 13*b*, 16, 18*b*, 20*b*, said upper reinforcement 47 is provided by a strip that is typically self-adhesive and that covers the inner surface of opening strip 45 and that is more or less the same width L as said opening strip.

In a fourth embodiment, such as that shown in FIG. 13*b*, an upper reinforcement 47 is provided that is similar to that in the third embodiment except that width L of the opening strip and reinforcement is not constant and typically increases from gripping tab 46.

Figure 1:
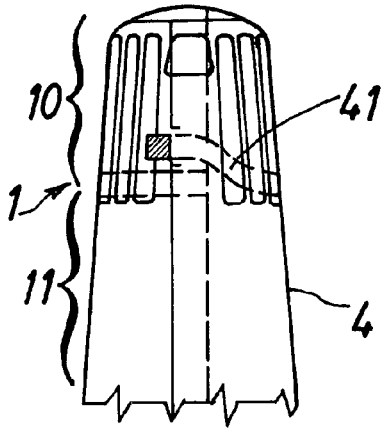
FIGS. 1 to 5 are partial lateral views of covers 1 of the background art obtained by rolling an arc of a skirt and bonding axial edges 60, 61 and showing various easy-to-open means located on skirt 4.
Figure 2:
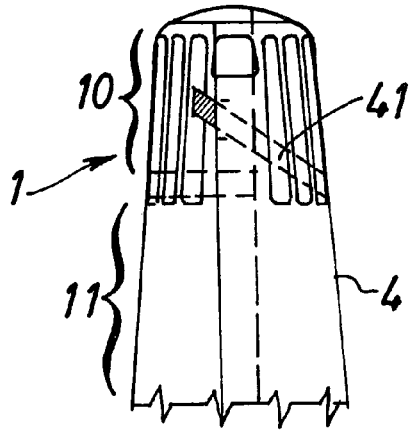
Figure 3:
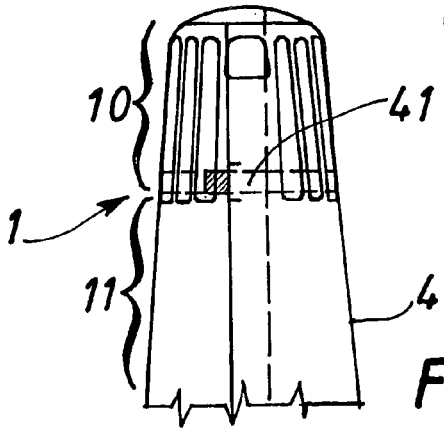
Figure 4:
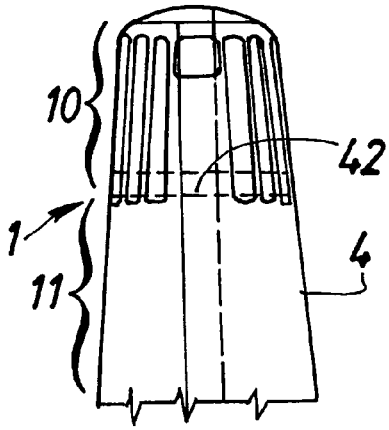
Figure 5:
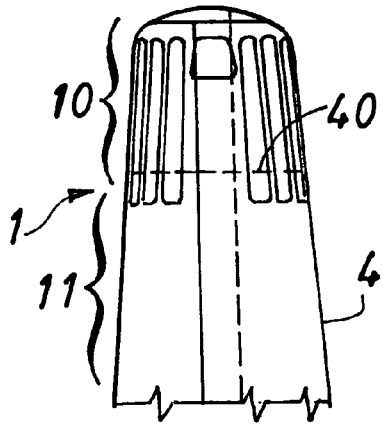

Bottles of champagne fitted with cork wires and covers 1 according to the test of the invention and bottles fitted with covers of the background art (covers with "Tircell" of FIG. 3) were subjected to an opening test performed by a group of people representing the population of consumers. They were instructed to proceed normally and not to be any more careful than they would usually be at a social occasion.

The covers of the invention were opened entirely satisfactorily in that:

a) the whole of the upper part of cover 10 was removed and the cork wire revealed in a single movement by pulling tab 46 between the thumb and index of one hand while the other held the bottle, b) said lower part 11 was not damaged, the rim of said lower part 11 matching said lower line of weakness 44 and being therefore relatively regular and circular.

On the other hand, with covers of the background art the results were very irregular with both opening problems as the "Tircell" did not always fulfill its function correctly and broke a considerable number of times. There were also edging problems as more often than not the lower part of the cover was either torn or came away from the neck.

It was also observed that once the bottles had been opened and left in an ice bucket and handled a number of times lower cover part 11 of the bottles of the invention was always intact whereas the same could not always be said of the bottles provided with covers of the background art.

ADVANTAGES OF THE INVENTION

The invention has the double advantage of, on the one hand, overcoming the drawbacks of easy-to-open covers for sparkling wines by enabling the entire upper part 10 of the cover to be removed in a single movement by one hand while the other holds the bottle, and, on the other, to enable covers to be produced without requiring considerable modifications in the standard production methods. The invention also discloses a great many embodiments that can set off certain aspects of the easy-to-open cover to advantage and therefore provides covers with a technical performance level that meets customers' requirements.

| LIST OF REFERENCES: | |
|---|---|
| COVER | 1 |
| UPPER PART OF COVER | 10 |
| LOWER PART OF COVER | 11 |
| BOTTLE | 2 |
| GLASS RING | 20 |
| CORK WIRE | 3 |
| TIGHTENING WIRE | 30 |
| LOOP | 31 |
| SKIRT OF COVER | 4 |
| LINE OF WEAKNESS | 40 |
| LINES OF WEAKNESS + TIRCELL | 41 |
| LINES OF WEAKNESS// | 42 |
| UPPER LINE OF WEAKNESS | 43 |
| partial UPPER LINE OF WEAKNESS | 430 |
| LOWER LINE OF WEAKNESS | 44 |
| OPENING STRIP | 45 |
| TAB | 46 |

-continued

| LIST OF REFERENCES: | |
|---|---|
| UPPER NOTCH | 460 |
| LOWER NOTCH | 461 |
| UPPER REINFORCEMENT (STRIP) | 47 |
| UPPER REINFORCEMENT (LINE) | 48 |
| HEAD | 5 |
| ARC OF SKIRT | 6 |
| AXIAL EDGES | 60,61 |
| UPPER EDGE | 62 |
| LINE OF ADHESIVE | 63 |
| UPPER RIM | 64 |
| LOWER PART | 65 |
| BONDED PART | 66 |
| REINFORCED PART/LOWER REINFORCEMENT | 67 |
| BONDED REINFORCEMENT (STRIP) | 68 |
| UPPER PART | 69 |
| NECK | 7 |
| CORK | 8 |
| CORK HEAD | 80 |
| GROOVES | 9 |

The invention claimed is:

1. Method for overcapping a bottle of sparkling wine with a cover comprising a head and a skirt, the sealed bottle of sparkling wine having a neck with an opening therein surrounded by a glass ring, the opening being sealed with a cork having a head which protrudes from the opening and which is secured to the neck with a metal tightening wire, the tightening wire being removably secured under the glass ring and including a wire loop, comprising the steps of:

providing a cover having a skirt with upper and lower lines of weakness defining a opening strip with a gripping tab at a free end of the strip, the lower line of weakness dividing the cover into an upper portion and an lower portion, and being disposed at a distance H from a top of the cover, distance H corresponding to an axial height between the protruding head of the cork at its top and the glass ring at its bottom, the skirt having a width L between the upper line of weakness and the lower line of weakness, wherein L is at least 0.5×H; and overcapping the sealed bottle of sparkling wine with the cover, wherein pulling on the gripping tab enables removal of the upper portion of the cover, and thereby exposes the loop, the tightening wire and cork to enable opening of the sealed bottle.

2. Method of claim 1, further comprising the steps of providing an additional means being selected from an upper reinforcement means, a lower reinforcement means, a means for fastening all or part of lower portion to the neck, and depositing an upper reinforcement or a lower reinforcement either by bonding a strip according to the mechanical characteristics required, which are resistant to tearing, and of a required shape, which is part of an annular sector, or by using a gun to apply a strip or line of melted plastic material that is adherent and that hardens when applied.

3. Method of claim 2, wherein said upper and lower reinforcement means are a self-adhesive label of suitable shape applied to said skirt.

4. Method of claim 1, wherein said gripping tab comprises notches to direct tearing strain when said cover is opened towards said two lines of weakness.

5. Method of claim 1, wherein said gripping tab comprises notches or recesses made in a film or sheet material constituting said cover.

6. Method of claim 1, wherein width $L_1$ of said tab ranges from 0.5 L to L with L ranging between 1.5 and 4 cm.

7. Method of claim 1, wherein said lower portion comprises a lower reinforcement means that increases the mechanical properties of said lower portion and adheres to an inner surface of said lower part at least along and parallel to said lower line of weakness, said lower reinforcement means further comprising an adhesive layer over a surface that can be activated and that is arranged to adhere to said neck.

8. Method of claim 7, wherein the entire said lower reinforcement means comprises a layer that can be activated and constitutes a circular strip the width of which is at least equal to 5 mm and that can extend over all or part of the height of said lower part and that is adjacent to at least the upper edge of said lower part along and parallel to said lower line of weakness.

9. Method of claim 7, wherein all or part of the said lower portion on its inner surface comprises a layer of glue or adhesive as fastening means that can be activated and that constitutes a bonded part that adheres to said neck, optionally after activation.

10. Method of claim 9, wherein said glue or adhesive comprises a complex layer including a layer that adheres to the glass and a layer that adheres to the material comprising the inner surface of said cover, selected from the group consisting of aluminum, paper and a layer of plastic material or varnish.

11. Method of claim 1, wherein said upper portion comprises an upper reinforcement means selected to increase the mechanical properties of said upper portion such that when said bottle is opened for said first time, said opening strip which is created by pulling on the gripping tab, removes the whole of said upper portion along with the gripping tab, and enables said upper line of weakness to be removed by said upper reinforcement means.

12. Method of claim 11, wherein said upper reinforcement means comprises a lateral end that reinforces all or part of said gripping tab.

13. Method of claim 12, wherein said lateral end extends beyond said gripping tab such that said lateral end assumes the role of said gripping tab when the cover is first opened.

14. Method of claim 11, wherein said upper reinforcement means comprises a reinforcement strip or line that includes a lower part or edge adjacent to lower line of weakness.

15. Method of claim 14, wherein said reinforcement means comprises an upper part or edge along the same reinforcement strip, said upper and lower edges being separated by a width L, that is constant or otherwise depending on angular position $\propto$, width L ranging between 0.4 and 4 cm, average width L being between 0.3 and 0.7 times H.

16. Method of claim 15, wherein width L is not constant and increases with the angular position $\propto$, width L being at its smallest at said tab where angle $\propto$ is equal to 0.

17. Method of claim 11, wherein said upper reinforcement means covers the entire interior surface or inner periphery of the free part of said opening strip.

18. Method of claim 11, wherein said upper reinforcement means comprises either a thin sheet or reinforcement strip of a plastic material, paper, or a layer, strip or line of plastic, resin, varnish or paint material.

19. Method of claim 1, wherein, said cover material is selected from the group consisting of Al, Al alloys, Sn, Sn alloys, shrinkable plastic, Al/PO/Al complex multilayers, Al/PO/paper, PO/Al/PO, and charged PO/Al/PO, wherein Al is a layer of aluminum and PO is a layer of polyolefin capable of containing a charge.

20. Method of claim 19, wherein the thickness of said material in sheets or strips ranges between 25 and 50 μm when the material is aluminum or an alloy, between 110 and 150 μm when the material is tin or an alloy, between 60 and 100 μm when the material is a shrinkable plastic film and between 60 and 110 μm when the material is a multilayer material.

21. A sealed bottle of sparkling wine including an easy-to-open overcapping cover, comprising:

a neck having an opening and a glass ring surrounding the opening;

a cork sealing the opening and having a protruding head;

a metal cork wire having a tightening wire fastening the cork to the neck of the bottle removably secured under the glass ring of the neck and further including an opening loop; and a cover overcapping the cork and neck of the bottle, comprising:

a head and a skirt of a sheet material, said sheet material being selected from the group consisting of aluminum or aluminum alloy of thickness between 25 and 50 μm, tin or tin alloy of thickness between 110 and 150 μm and aluminum and plastic multilayer material of thickness between 60 and 110 μm;

an easy-to-open means provided on said skirt and including an upper line of weakness and a lower line of weakness, the upper and lower lines of weakness defining an opening strip having a width L, and the upper and lower lines of weakness being substantially parallel and extend substantially around a whole circumference of the cover, the easy-to-open means also comprising a gripping tab disposed at a free end of the opening strip, the gripping tab comprising notches disposed at upper and lower ends thereof to direct tearing of the opening strip during a first opening of the bottle by pulling on the gripping tab and removing the upper part along the lower line of weakness, the lower line of weakness being located on the cover at a height H from a top of the cover, the height H defining a partition of the cover into the upper part and the lower part, wherein the lower line of weakness is located with respect to the neck of the bottle such that removal of the upper part after tearing of the opening strip provides access to the loop, tightening wire and the cork, the lower part remaining intact on the neck, and wherein the upper line of weakness is separated from the lower line weakness by a distance L at least equal to 0.5 H.

22. Cover of claim 21, further comprising means for fastening said lower part to said neck, and means for reinforcing said upper part so that when said bottle is opened, said upper part is removed wholly.

23. Cover of claim 21, wherein the gripping tab comprises notches to direct tearing strain when said cover is opened towards said two lines of weakness such that said cover is opened easily, ensuring the remaining lower part of the cover located beneath said lower line stays intact.

24. Cover of claim 21, wherein said gripping tab further comprises notches or recesses made in a film or sheet material constituting said cover.

25. Cover of claim 21, wherein width $L_1$ of said tab ranges from 0.5 L to L with L ranging between 1.5 and 4 cm.

26. Cover of claim 21, wherein said lower part comprises a lower reinforcement means that increases the mechanical properties of said lower part and adheres to an inner surface of said lower part at least along and parallel to said lower line of weakness, said lower reinforcement means comprising an adhesive layer over a surface that can be activated and that is constructed and arranged to adhere to said neck.

27. Cover of claim 26, wherein the entire said lower reinforcement comprises a layer that can be activated and constitutes a circular strip having a width which is at least equal to 5 mm and that can extend over all or part of the height of said lower part and that is adjacent to at least the upper edge of said lower part along and parallel to said lower line of weakness.

28. Cover of claim 26, wherein all or part of said lower part over its inner surface comprises a layer of glue or adhesive as fastening means that can be activated and that constitutes a bonded part that adheres to said neck, optionally after activation.

29. Cover of claim 28, wherein said glue or adhesive comprises a complex layer including a layer that adheres to the glass and a layer that adheres to the material comprising the inner surface of said cover, selected from the group consisting of aluminum, paper and a layer of plastic material or varnish.

30. Cover of claim 21, wherein said upper part comprises an upper reinforcement means selected to increase the mechanical properties of said upper part such that when said bottle is opened for said first time said opening strip, which is created by pulling on gripping tab, removes the whole of said upper part along with it and to enable said upper line of weakness to be removed by said upper reinforcement means.

31. Cover of claim 30, wherein said upper reinforcement means comprises a lateral end that reinforces all or part of said gripping tab.

32. Cover of claim 31, wherein said lateral end extends beyond said gripping tab such that said lateral end assumes the role of said gripping tab when the cover is first opened.

33. Cover of claim 30, wherein said upper reinforcement means comprise a reinforcement strip or line that includes a lower part or edge adjacent to lower line of weakness.

34. Cover of claim 33, wherein said upper reinforcement means comprises an upper part or edge along the same reinforcement strip, said upper and lower edges being separated by a width L, that is constant or otherwise depending on angular position $\propto$, width L ranging typically between 0.4 and 4 cm, average width L being between 0.3 and 0.7 times H.

35. Cover of claim 34, wherein said width L is not constant and increases with the angular position $\propto$, width L being at its smallest at said tab where angle $\propto$ is equal to 0.

36. Cover of claim 30, wherein said upper reinforcement means covers the entire interior surface or inner periphery of the free part of said opening strip.

37. Cover of claim 30, wherein said upper reinforcement means comprises either a thin sheet or reinforcement strip of a plastic material, paper, or a layer, strip or line of plastic, resin, varnish or paint material.

38. Cover of claim 21, wherein said cover material is selected from the group consisting of Al, Al alloys, Sn, Sn alloys, shrinkable plastic, Al/PO/Al complex multilayers, Al/PO/paper, PO/Al/PO, and charged PO/Al/PO, wherein Al is a layer of aluminum and PO is a layer of polyolefin capable of containing a charge.

* * * * *